United States Patent [19]

Hoecke

[11] 4,347,782

[45] Sep. 7, 1982

[54] TELESCOPABLE WINTER/SUMMER AIR RECIRCULATOR

[75] Inventor: David A. Hoecke, Berea, Ohio

[73] Assignee: Enercon Systems, Incorporated, Cleveland, Ohio

[21] Appl. No.: 93,595

[22] Filed: Nov. 13, 1979

[51] Int. Cl.[3] ..... F24F 13/10

[52] U.S. Cl. ..... 98/33 A; 98/40 N; 415/157

[58] Field of Search ..... 98/33 A, 38 R, 38 E, 98/38 F, 40 VT, 40 N; 415/148, 157, 128, 126

[56] References Cited

U.S. PATENT DOCUMENTS

| | | | |
|---|---|---|---|
| 1,536,846 | 5/1925 | Heath et al. | 415/148 |
| 2,331,063 | 10/1943 | Wehmeyer | 415/148 |
| 2,398,380 | 4/1946 | Kisling | 415/148 |
| 2,787,946 | 4/1957 | Gannon | 98/38 E |
| 3,729,271 | 4/1973 | Bonaldi | 415/148 |
| 3,827,342 | 8/1974 | Hughes | 98/33 A |
| 4,103,146 | 7/1978 | Rampe | 165/76 X |

FOREIGN PATENT DOCUMENTS

| | | | |
|---|---|---|---|
| 1137543 | 10/1962 | Fed. Rep. of Germany | 98/38 E |

*Primary Examiner*—Albert J. Makay
*Assistant Examiner*—Harold Joyce
*Attorney, Agent, or Firm*—Alfred D. Lobo

[57] ABSTRACT

A device is disclosed which recirculates air to raise air temperature near the floor in winter, and to provide a direct flow of air blown generally horizontally slightly above persons standing on the floor in summer. A fan assembly is housed in a unitary duct-like housing which is open near its base to take in air. The duct-like housing is capped with an outlet hood which adjustably telescopes on the housing so that air flow from openings in the outlet hood can be adjusted for winter or summer operation.

2 Claims, 2 Drawing Figures

TELESCOPABLE WINTER/SUMMER AIR RECIRCULATOR

BACKGROUND OF THE NVENTION

The problem of energy conservation has inspired numerous solutions which deservedly have received much attention in recent times. The particular problem of heating large enclosed spaces such as commercial buildings, industrial plants and the like has attracted an especially large amount of attention wherever the comfort of personnel is to be maintained at reasonable cost. Air recirculation within a large enclosed space to be heated is the well-recognized manner of raising the temperature of the low-lying ambient air, it being known since the earliest times that warm air in a large enclosed space rises above cool air and collects near the roof. Numerous solutions to the problem have been advanced over the years, exemplified by the teachings in an article titled "Recirculation as Applied to the Butler University Field House" by John M. Robertson in Heating and Ventilating, July-August (1929), where it is taught how to maintain an athletic building at a comfortable temperature in winter without resorting to ducts to carry away heated air.

U.S. Pat. No. 2,984,416 provides additional details as to a method employed for ductlessly heating unpartitioned interiors of large buildings with relatively low temperature air at about 125° F., recirculated at relatively low velocity but with high volume. More recently, U.S. Pat. No. 4,103,146 discloses a trimodular apparatus for use in winter, which uses upper and lower modules with at least one intermediate module arranged one atop the other and releasably secured together to define a vertical chamber extending through the modules. For summer use air is vented from the building. It is stated that for winter use, the device draws in and discharges air in stratified layers and at a velocity sufficient to establish a generally toroidal flow of air toward the walls of the building. Further, it is stated that this toroidal flow is sufficient to establish a counter toroidal flow in the air above the apparatus. Any recirculation of air, where a relatively large volume of air is being recirculated within an enclosed building, will necessarily provide a generally upward, outward, downward and return flow of air such as is described in either of the foregoing references, among many others. Whether the flow is generally toroidal or not will depend upon the size and shape of the openings through which air jets issue and which are then recirculated.

At relatively low velocities lower than about 300 ft/min, computed as the volumetric flow of air through the area of an orifice, in this instance, the openings or air outlets through which air is blown, the generally horizontal outward flow of air from the air outlets shown in FIG. 8 of U.S. Pat. No. 2,984,416 or FIG. 5 of U.S. Pat. No. 4,103,146, is not obtained unless the air outlets are relatively close to the roof as illustrated in said FIG. 8. The horizontal outward flow illustrated in FIG. 5 of U.S. Pat. No. 4,103,246 fails to draw in quiescent air from near the roof, when the roof is at least twice as high as the outlets are from the floor. This illustration of the heating mode (the "winder mode") leads away from an understanding of the effective operation of the patented apparatus in its winter mode. As already indicated, generally horizontal flow is obtained in U.S. Pat. No. 2,984,416 because the air outlets are relatively close to the roof. In each of the foregoing references, horizontal flow is associated with operation of a recirculator in its winter mode, and leads away from utilizing horizontal flow for summer cooling.

It has now been found that to generate a generally horizontal outward flow of air from the outlet of a recirculator, when the roof is at least twice as high as the outlets are from the floor level, it is critical that air velocity be in excess of 500 ft/min., and that the shape of the outlet be rectangular with the height of the outlet being about one-fourth of its width.

Though there are numerous references which disclose air recirculators, none addresses itself to providing variable velocity and direction of outlet airflow by telescopably adjusting the orifice area of an air outlet with a fixed orifice area. The relevant prior art references contemplate solving the problem of adjusting air flow through an air outlet of fixed cross-sectional area either (a) by varying the air flow capacity of the fan, or (b) providing baffles or dampers on the outlet to damp air flow. Double deflection grilles are uneconomical, and large blade deflectors protrude from the housing which is undesirable because it can be dangerous. Where multiple air outlets are provided, one or more is closed to provide increased air velocity through the ones left open. As applied to an air recirculator of the type disclosed herein, each of the prior art solutions to the problem is an impractical solution.

The practical solution to the problem is to provide a recirculator (i) which can be shipped as an assembly in a standard truck, in a vertical position; (ii) which does not require that the purchaser assemble the recirculator; and, (iii) which can be used in summer as a cooling fan (referred to as a "man-cooler") to blow air directly upon and cool persons working on the floor of the building in which the recirculator is placed. A solution which requires a telescopable outlet hood is a simple and effective way to provide the practical solution. Besides providing a device which can be used advantageously in both hot and cold weather, the telescopable hood permits the unit to be shipped fully assembled. The customer needs to do no more than adjust the hood depending upon the weather outside the building, and connect the device to a source of electrical power to drive the fan.

SUMMARY OF THE NVENTION

It is economically desirable to use an air recirculator all year around, and particularly in both summer and winter. This invention stems from the discovery that prior art air recirculators are only effective either in summer or in winter, but not both; and, that both summer and winter operation can be advantageously achieved by the simple expedient of varying (a) the air velocity only relatively slightly, and, (b) the direction of effluent air from the recirculator's air outlets. It was further discovered that a telescopable outlet hood provided a surprising effective and economical means for effecting both (a) and (b) when the recirculator's air outlets are placed about 7 ft above the floor on which it rests, and, as an added benefit allows shipment of the recirculator, fully assembled, in a standard truck.

It is therefore a general object of this invention to provide an enduringly simple recircular which is compellingly functional. It can provide air recirculation in winter to mix warm air lying near the roof of a building with cool air near ground level; and also, it can provide a relatively high velocity air stream directed substantially horizontally in summer, so that by direct flow of air slightly above persons standing on the floor, it cools them without substantially recirculating hot air which lies quiescent near the roof of the building.

It is a specific object of this invention to provide a novel bi-modular air recirculator which is an improvement upon the tri-modular device described in U.S. Pat. No. 4,103,146; the novel air recirculator is at the same time more simple in its construction, yet provides in winter due to additional warmth, and comfort in summer due to additional cooling, both derived from a telescopable outlet hood. In a winter mode operation, the outlet hood is adjustably positioned to force effluent air at any desired angle in the range from about 30° to about 60° from the horizontal. In a summer mode operation, the outlet hood is adjustably positioned to force effluent air out at an angle less than 10° from the horizontal.

It is a still more specific object of this invention to provide a fully assembled air recirculation device which has only two sections, namely a duct-like housing section in which a fan assembly is housed, and, an outlet hood against which air is blown by the fan so that the air is then deflected from the outlet hood at a predetermined angle to the horizontal.

DETAILED DESCRIPTION OF THE INVENTION

Figure 1:
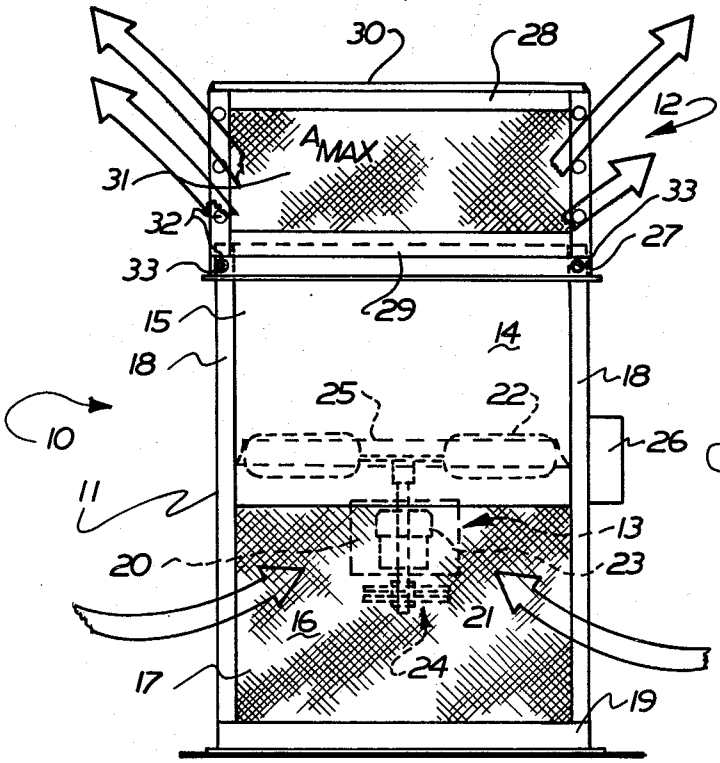
FIG. 1 is a front elevational view diagrammatically illustrating the air recirculator of this invention in an embodiment for use in winter.

Referring now to FIG. 1 there is shown a front elevational view of an air recirculator indicated generally by reference numeral 10, which includes a unitary duct-like housing of rectangular cross-section, indicated generally by reference numeral 11, and an outlet hood indicated generally by reference numeral 12. By "unitary" I mean that the housing 11 is constructed as a single unit.

The duct-like housing 11 houses a fan assembly, indicated generally by reference numeral 13. The housing 11 includes an enclosed portion 14 extending from the top of the housing, downwards for about one half its height, which enclosed portion is formed by air-impermeable side walls 15 formed of sheet metal, preferably steel or aluminum, welded to four continuous vertical supports 18, one at each corner of the square housing. The top of the housing 11 is preferably slightly less than 7 ft above the floor on which the air recirculator rests.

If desired, heat transfer means (not shown) may be inserted in the enclosed portion 14, so that in winter, air blown over heating coils will be warmed, and in summer, air blown over cooling coils will be cooled. Heat transfer means in winter conventionally comprise heating coils such as are in general use, and are specifically disclosed in U.S. Pat. Nos. 1,620,767 and 4,103,146 among others. Heat transfer means in summer conventionally comprise cooling coils through which cool water or other cool fluid is flowed. Alternatively the cooling coil may be part of a refrigeration system.

The enclosed portion 14 terminates in an open portion 16 which extends to the base 19 of the housing. The base is constructed from additional lengths of angle iron or other structural members which can conveniently be of stock having the same specifications as that used for the vertical supports 18. The open portion 16 has air-permeable side walls 17 which provide an intake for essentially unrestricted air flow. Typically, the side walls 17 may be formed from steel mesh or other expanded metal, or, air filters may be used such as are commercially made from glass fiber batte suitably held in filter holders (not shown) adapted to be attached to the vertical supports 18. One of the air-permeable side walls 17 is removably affixed to the supports 18 to allow access to the fan assembly 13, the remaining three sidewalls 17 being preferably welded to the supports.

A fan having a shaft 21 and plural fan blades 22 is mounted in the enclosed portion 14 with the shaft 21 longitudinally coaxially disposed relative to the axis of the duct-like housing 11. An electric motor 23 is mounted on a mounting plate 20 affixed within the housing 11, and the motor which is suspended in the open portion 16, is drivingly engaged with the fan by a drive belt trained on sheaves, the drive belt and sheaves also suspended in the open portion 16, being indicated generally by reference numeral 24. Other drive means than an electric motor may be employed, such as for example an air motor, but the drive means are outside the enclosed portion 14, except of course the portion of the shaft 21 adjacent the fan blades. A shroud 25 is provided in enclosed portion 14 around the fan blades 22, to boost the efficiency of the fan blades. The capacity of the fan is preferably in the range from about 10,000 to about 20,000 $ft^3$/min (cfm). A control box 26 is mounted exteriorly of the housing 11, the control box housing conventional electrical controls for the fan assembly 13.

The outlet hood 12 is constructed with vertical supports 27 connecting upper and lower end frames 28 and 29 respectively of the hood, the supports being formed of the same stock as the vertical supports 27 of the outlet hood, and the supports 18 of the housing. Upper end frame 28 has an end plate 30 welded to it. The end plate 30 is preferably a sheet of metal which serves as a movable deflector to obstruct and deflect the vertically upward flow of air blown by the fan, so that the air is then deflected at a preselected angle determined by the position of the outlet hood on the housing 11 and the rate of flow of air. The position of the outlet hood 12 is adjustable because the dimensions of the hood are such that it slidably fits over the housing 11 so that it ca be telescoped: (i) to a fully extended position providing maximum open area $A_{max}$ for flow of effluent air as shown by the cross-hatched area of mesh in FIG. 1; or, (ii) to a partially retracted position to provide a smaller open area $A_{part}$ for flow of air as shown by the cross-hatched area of mesh in FIG. 2; or, (iii) to a fully retracted position when the recirculator is not in use, as when it is shipped from one location to another. The vertical supports 18 and 27 are each provided with holes 32 which when aligned, accept bolts or pins 33 which serve to position the outlet hood on the housing at any desired height.

Like the open portion 16 of the housing 11, the outlet hood 12 has air-permeable side walls 31 through which air is blown out. The volume per unit of time of air blown upward by the fan, and, the position of the end plate relative to the top of the housing 11 will etermine the angle at which the air flowing from the walls 31 leaves them. In FIG. 1, the winter embodiment, the outlet hood 12 is positioned in its fully extended position so that the open area on each side of the hood is about 22 ins high and about 4 ft wide. As a consequence, air flow from the hood is upwards at an angle of about 35° from the horizontal, as graphically illustrated by the arrows. Lower positions of the end wall decrease the angle of flow of effluent air, and higher positions increase the angle. Air flow in the winter mode ranges from about 30° to about 60° from horizontal and the velocity of the effluent air, calculated on the basis of open rectangular area of the outlets, ranges from about 6 to about 12 ft/sec.

Figure 2:
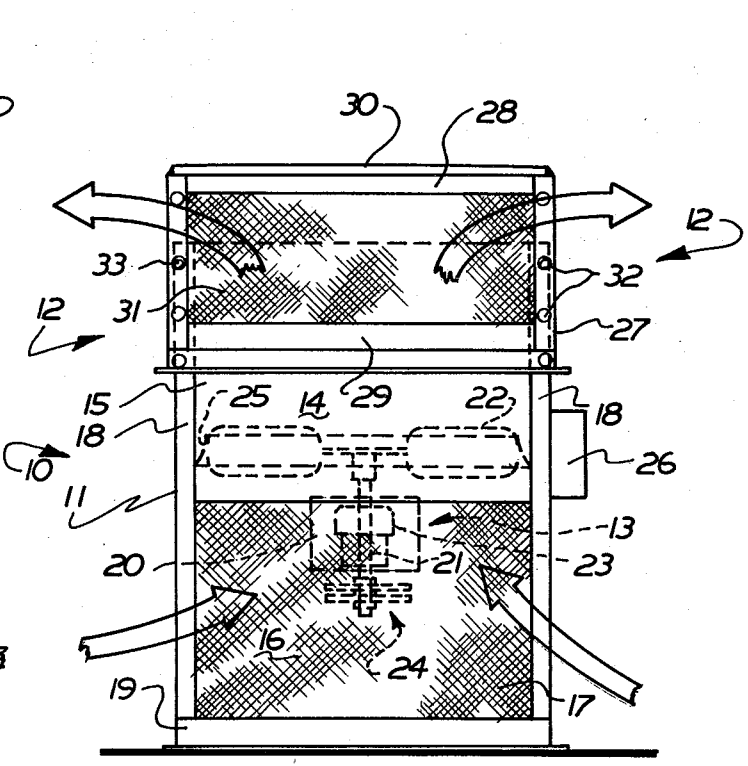
FIG. 2 is a front elevational view diagrammatically illustrating the air recirculator of this invention in an embodiment for use in summer.

Referring now to FIG. 2, there is illustrated the summer mode of operation of the air recirculator in which the outlet hood 12 is partially retracted to the position shown. Pins 33, inserted through aligned holes 32 in the vertical supports 18 and 27, position the outlet hood 12 so that the open area of each outlet is reduced to about 12 ins high and about 4 ft wide. As a consequence, with substantially the same rate of air flow from the fan, air flow from the outlet hood is substantially horizontal, as graphically illustrated by the arrows. Like side walls 17 of the housing 11, the side walls 31 are preferably made of steel mesh or other expanded metal which is welded to the vertical supports 27, or the side walls may include air filters suitably held in place for mounting on the vertical supports 27. Air flow in the summer mode ranges from about 0° to about 10° from the horizontal and the velocity of the effluent air, calculated as before, is in the range from about 25% to about 50% higher than the velocity in the winter mode. Thus if the velocity of effluent air in the winter mode is 8 ft/sec the preferred velocity in the summer mode is in the range from 10 ft/sec to about 12 ft/sec. With the preferred setting of the outlet hood for operation in the summer mode, the outlets for effluent air are about 7 ft above the floor on which the recirculator rests. With the outlets at this height, air is blown slightly above the heads of persons standing on the floor. The return air to the intake of the air recirculator provides cool air motion where the people are, thus giving them a feeling of cool comfort.

I claim:

1. An air recirculator to be placed on the floor of a building for recirculating air therewithin at any time of the year, said air recirculator comprising:

(A) a unitary vertical duct-like housing having
- (i) air-impermeable side walls extending downwardly for about one half said housing's height,
- (ii) air-permeable side walls extending downwardly for the remaining portion of said housing's height, terminating in a base, and
- (iii) a fan assembly disposed within said air-impermeable walls with the longitudinal axis of the fan longitudinally axially disposed therewithin to blow air vertically upwards, and (B) a telescopable outlet hood having
- (i) air-permeable side walls which telescopes adjustable over said air-impermeable walls of said housing,
- (ii) an air-impermeable end plate to serve as a movable deflector,
  - (a) which is locatable, when said outlet hood is fully extended as in a winter mode of operation, to deflect air from outlets in said outlet hood upwardly and outwardly at an angle in the range from about 30° to about 60° from the horizontal, at a winter air velocity in the range from about 6 to about 12 ft/sec
  - (b) which is locatable, with said outlet hood in a partially retracted position as in a summer mode of operation, to deflect air from outlets in said outlet hood outwardly and substantially horizontally slightly above persons standing on said floor, and,
  - (c) which is locatable with said outlet hood in a fully retracted position, as when the device is to be shipped, to a vertical overall height of less than 8 ft.

2. The air recirculator of claim 1 wherein, in said summer mode of operation, air from outlets in said outlet hood is deflected outwardly at an angle in the range from about 0° to about 10° from the horizontal, at a summer air velocity from about 25% to about 50% higher than said winter air velocity.

* * * * *